US009666947B2

(12) United States Patent
Boryssenko et al.

(10) Patent No.: US 9,666,947 B2
(45) Date of Patent: May 30, 2017

(54) DIELECTRIC-FREE METAL-ONLY DIPOLE-COUPLED BROADBAND RADIATING ARRAY APERTURE WITH WIDE FIELD OF VIEW

(71) Applicant: Nuvotronics, LLC, Radford, VA (US)

(72) Inventors: Anatoliy O. Boryssenko, Belchertown, MA (US); Kenneth Vanhille, Cary, NC (US); Benjamin L. Cannon, Cary, NC (US)

(73) Assignee: NUVOTRONICS, INC, Radford, VA (US)

( * ) Notice: Subject to any disclaimer, the term of this patent is extended or adjusted under 35 U.S.C. 154(b) by 6 days.

(21) Appl. No.: 14/567,655

(22) Filed: Dec. 11, 2014

(65) Prior Publication Data

US 2015/0162665 A1 Jun. 11, 2015

Related U.S. Application Data

(60) Provisional application No. 61/914,693, filed on Dec. 11, 2013.

(51) Int. Cl.

| | |
|---|---|
| ***H01Q 21/26*** | (2006.01) |
| ***H01Q 9/28*** | (2006.01) |
| ***H01Q 1/48*** | (2006.01) |
| ***H01Q 9/26*** | (2006.01) |
| ***H01Q 21/06*** | (2006.01) |
| ***H01Q 23/00*** | (2006.01) |
| ***H01Q 25/00*** | (2006.01) |
| ***H01Q 5/25*** | (2015.01) |
| ***H01Q 5/40*** | (2015.01) |

(52) U.S. Cl.
CPC ..... *H01Q 9/28* (2013.01); *H01Q 1/48* (2013.01); *H01Q 5/25* (2015.01); *H01Q 5/40* (2015.01); *H01Q 9/26* (2013.01); *H01Q 21/062* (2013.01); *H01Q 21/26* (2013.01); *H01Q 23/00* (2013.01); *H01Q 25/00* (2013.01)

(58) Field of Classification Search
CPC ..... H01Q 5/48; H01Q 9/265; H01Q 9/285; H01Q 19/108
See application file for complete search history.

(56) References Cited

U.S. PATENT DOCUMENTS

| | | | | |
|---|---|---|---|---|
| 4,218,685 | A | 8/1980 | Ellis, Jr. | |
| 6,317,099 | B1 * | 11/2001 | Zimmerman | H01Q 1/246 343/747 |
| 6,356,241 | B1 | 3/2002 | Jaeger et al. | |
| 6,822,616 | B2 | 11/2004 | Durham et al. | |
| 6,842,158 | B2 * | 1/2005 | Jo | H01Q 1/243 343/700 MS |

(Continued)

OTHER PUBLICATIONS

Nakano, M., et al., "Feed Circuits of Double-Layered Self-Diplexing Antenna for Mobile Satelite Communications", Transactions on Antennas and Propagation, vol. 40, No. 1, Oct. 1992, pp. 1269-1271.

(Continued)

*Primary Examiner* — Dameon E Levi
*Assistant Examiner* — Hasan Islam
(74) *Attorney, Agent, or Firm* — Niels Haun; Dann, Dorfman, Herrell and Skillman, P.C.

(57) ABSTRACT

Dielectric-free, metal-only, dipole-coupled broadband radiating array aperture with wide field of view.

9 Claims, 10 Drawing Sheets

(56) References Cited

U.S. PATENT DOCUMENTS

| | | | | |
|---|---|---|---|---|
| 7,109,936 | B2 * | 9/2006 | Mizoguchi | H01Q 9/42 343/702 |
| 7,764,236 | B2 * | 7/2010 | Hill | H01Q 1/243 343/702 |
| 2005/0040994 | A1 * | 2/2005 | Mazoki | G06K 19/07786 343/809 |
| 2008/0074339 | A1 * | 3/2008 | Lee | H01Q 9/26 343/803 |
| 2010/0007572 | A1 * | 1/2010 | Jones | H01Q 9/28 343/798 |
| 2013/0002501 | A1 * | 1/2013 | Li | H01Q 5/35 343/767 |

OTHER PUBLICATIONS

Vallecchi, A. et al. "Dual-Polarized Linear Series-Fed Microstrip ArraysWith Very Low Losses and Cross Polarization," IEEE Antennas and Wireless Propagation Letter, vol. 3, 2004. pp. 123-126.

Guo, Y.X. et al. "L-probe proximity-fed short-circuited patch antennas," Electronics Letters, vol. 35 No. 24, Nov. 25, 1999. pp. 2069-2070.

Hsu, Wen-Hsiu et al. "Broadband Aperture-Coupled Shorted-Patch Antenna," Microwave and Optical Technology Letters, vol. 28, No. 5, Mar. 5, 2001. pp. 306-307.

Gao, S. et al. "A Broad-Band Dual-Polarized Microstrip Patch AntennaWith Aperture Coupling," IEEE Transactions on Antennas and Propagation, vol. 51, No. 4, Apr. 2003. pp. 898-900.

Sevskiy, S. and Wiesbeck, W., "Air-Filled Stacked-Patch Antenna," ITG-Fachberichte. No. 178, (2003). pp. 53-56.

Ghannoum, H. et al. "Probe Fed Stacked Patch Antenna for UWB Sectoral Applications," IEEE International Conference on Ultra-Wideband 2005. pp. 97-102.

Zurcher, J. "Broadband Patch Antennas," Chapter 3, 1995. pp. 45-61.

Holzheimer, T., et al, "Performance Enhancements with Applications of the Coaxial Cavity Antenna," 2001 Antenna Applications Symposium, Allerton Park, Monticello, IL, Sep. 19-21, 2001, pp. 171-193.

Holzheimer, T., "The Low Dispersion Coaxial Cavity as an Ultra Wideband Antenna", Conference on Ultra Wideband Systems and Technologies, 2002, pp. 333-336.

Gao, S.C., et al., Dual-polarised Wideband Microstrip Antenna, Electronic Letters, Aug. 30, 2001, vol. 37, No. 18, pp. 1106-1107.

J. R. Mruk, N. Sutton, D. S. Filipovic, "Micro-coaxial fed 18 to 110 GHz planar log-periodic antennas with RF transitions," IEEE Trans. Antennas Propag., vol. 62, No. 2, Feb. 2014, pp. 968-972.

H. Zhou, N. A. Sutton, D. S. Filipovic, "Surface micromachined millimeter-wave log-periodic dipole array antennas," IEEE Trans. Antennas Propag., Oct. 2012, vol. 60, No. 10, pp. 4573-4581.

J. M. Oliver, J.-M. Rollin, K. Vanhille, S. Raman, "A W-band micromachined 3-D cavity-backed patch antenna array with integrated diode detector," IEEE Trans. Microwave Theory Tech., Feb. 2012, vol. 60, No. 2, pp. 284-292.

Mruk, J.R., Saito, Y., Kim, K., Radway, M., Filipovic, D.S., "Directly fed millimetre-wave two-arm spiral antenna," Electronics Letters, Nov. 25 2010, vol. 46 , issue 24, pp. 1585-1587.

Y. Saito, M.V. Lukic, D. Fontaine, J.-M. Rollin, D.S. Filipovic, "Monolithically Integrated Corporate-Fed Cavity-Backed Antennas," IEEE Trans. Antennas Propag., vol. 57, No. 9, Sep. 2009, pp. 2583-2590.

Y. Saito, J.R. Mruk, J.-M. Rollin, D.S. Filipovic, "X- through Q-band log-periodic antenna with monolithically integrated u-coaxial impedance transformer/feeder," Electronic Letts. Jul. 2009, pp. 775-776.

M. V. Lukic, and D. S. Filipovic, "Surface-micromachined dual Ka-and cavity backed patch antenna," IEEE Trans. Antennas Propag., vol. 55, No. 7, pp. 2107-2110, Jul. 2007.

B. Cannon, K. Vanhille, "Microfabricated Dual-Polarized, W-band Antenna Architecture for Scalable Line Array Feed," 2015 IEEE Antenna and Propagation Symposium, Vancouver, Canada, Jul. 2015.

T. E. Durham, C. Trent, K. Vanhille, K. M. Lambert, F. A. Miranda, "Design of an 8-40 GHz Antenna for the Wideband Instrument for Snow Measurements (WISM)," 2015 IEEE Antenna and Propagation Symposium, Vancouver, Canada, Jul. 2015.

K. M. Lambert, F. A. Miranda, R. R. Romanofsky, T. E. Durham, K. J. Vanhille, "Antenna characterization for the Wideband Instrument for Snow Measurements (WISM)," 2015 IEEE Antenna and Propagation Symposium, Vancouver, Canada, Jul. 2015.

A. Boryssenko, J. Arroyo, R. Reid, M.S. Heimbeck, "Substrate free G-band Vivaldi antenna array design, fabrication and testing" 2014 IEEE International Conference on Infrared, Millimeter, and Terahertz Waves, Tucson, Sep. 2014.

N. Chamberlain, M. Sanchez Barbetty, G. Sadowy, E. Long, K. Vanhille, "A dual-polarized metal patch antenna element for phased array applications," 2014 IEEE Antenna and Propagation Symposium, Memphis, Jul. 2014. pp. 1640-1641.

N. Jastram, D. S. Filipovic, "Parameter study and design of W-band micromachined tapered slot antenna," Proc. IEEE-APS/URSI Symposium, Orlando, FL, Jul. 2013, pp. 434-435.

N.A. Sutton, D. S. Filipovic, "V-band monolithically integrated four-arm spiral antenna and beamforming network," Proc. IEEE-APS/URSI Symposium, Chicago, IL, Jul. 2012, pp. 1-2.

J.R. Mruk, Y. Saito, K. Kim, M. Radway, D. Filipovic, "A directly fed Ku- to W-band 2-arm Archimedean spiral antenna," Proc. 41st European Microwave Conf., Oct. 2011, pp. 539-542.

E. Cullens, L. Ranzani, E. Grossman, Z. Popovic, "G-Band Frequency Steering Antenna Array Design and Measurements," Proceedings of the XXXth URSI General Assembly, Istanbul, Turkey, Aug. 2011.

J. M. Oliver, P. E. Ralston, E. Cullens, L. M. Ranzani, S. Raman, K. Vanhille, "A W-band Micro-coaxial Passive Monopulse Comparator Network with Integrated Cavity-Backed Patch Antenna Array," 2011 IEEE MTT-S Int. Microwave, Symp., Baltimore, MD, Jun. 2011.

H. Zhou, N. A. Sutton, D. S. Filipovic, "Wideband W-band patch antenna," 5th European Conference on Antennas and Propagation , Rome, Italy, Apr. 2011, pp. 1518-1521.

N. Sutton, D.S. Filipovic, "Design of a K- thru Ka-band modified Butler matrix feed for a 4-arm spiral antenna," 2010 Loughborough Antennas and Propagation Conference, Loughborough, UK, Nov. 2010, pp. 521-524.

Z. Popovic, "Micro-coaxial micro-fabricated feeds for phased array antennas," in IEEE Int. Symp. on Phased Array Systems and Technology, Waltham, MA, Oct. 2010, pp. 1-10. (Invited).

L. Ranzani, N. Ehsan, Z. Popovi‡, "G-band frequency-scanned antenna arrays," 2010 IEEE APS-URSI International Symposium, Toronto, Canada, Jul. 2010.

Oliver, J.M. et al., "A 3-D micromachined W-band cavity backed patch antenna array with integrated rectacoax transition to wave guide," 2009 Proc. IEEE International Microwave Symposium, Boston, MA 2009.

J. Mruk, Z. Hongyu, M. Uhm, Y. Saito, D. Filipovic, "Wideband mm-Wave Log-Periodic Antennas," 3rd European Conference on Antennas and Propagation, pp. 2284-2287, Mar. 2009.

M. Lukic, K. Kim, Y. Lee, Y. Saito, and D. S. Filipovic, "Multi-physics design and performance of a surface micromachined Ka-band cavity backed patch antenna," 2007 SBMO/IEEE Int. Microwave and Optoelectronics Conf., Oct. 2007, pp. 321-324.

M. V. Lukic, and D. S. Filipovic, "Integrated cavity-backed ka-band phased array antenna," Proc. IEEE-APS/URSI Symposium, Jun. 2007, pp. 133-135.

K. Vanhille, M. Lukic, S. Rondineau, D. Filipovic, and Z. Popovic, "Integrated micro-coaxial passive components for millimeter-wave antenna front ends," 2007 Antennas, Radar, and Wave Propegation Conference, May 2007.

D. Filipovic, G. Potvin, D. Fontaine, C. Nichols, Z. Popovic, S. Rondineau, M. Lukic, K. Vanhille, Y. Saito, D. Sherrer, W. Wilkins, E. Daniels, E. Adler, and J. Evans, "Integrated micro-coaxial Ka-band antenna and array," GomacTech 2007 Conference, Mar. 2007.

(56) References Cited

OTHER PUBLICATIONS

M. Lukic, D. Fontaine, C. Nichols, D. Filipovic, "Surface micromachined Ka-band phased array antenna," Presented at Antenna Applic. Symposium, Monticello, IL, Sep. 2006.

* cited by examiner

DIELECTRIC-FREE METAL-ONLY DIPOLE-COUPLED BROADBAND RADIATING ARRAY APERTURE WITH WIDE FIELD OF VIEW

RELATED APPLICATIONS

This is application claims the benefit of priority of U.S. Provisional Application No. 61/914,693, filed on Dec. 11, 2013, the entire contents of which application are incorporated herein by reference.

FIELD OF THE INVENTION

The present invention relates generally to radiating array apertures, and more particularly, but not exclusively, to coupled-dipole broadband arrays which may be metal-only and dielectric-free.

BACKGROUND OF THE INVENTION

There are still unmet demands from defense and commercial markets for very low profile array antennas capable of supporting transmit and receive operations with arbitrary polarization states and the ability to scan down to angles approaching the grazing regime with acceptable active reflection coefficients. Besides just the aforementioned major electrical requirements, such prospective arrays have to be of high radiation efficiency and low insertion loss along with their advanced structural properties. Such structural properties may include low complexity to fabricate, assemble and install while minimizing or excluding manual labor, as well as mechanical ability to withstand, for example, multi-G impacts. Also using predominantly low-cost fabrication materials and technologies suitable for mass production is preferable to achieve break-through technical and economic features.

SUMMARY OF THE INVENTION

In one of its aspects, the invention relates to the design and implementation of ultra-broadband (i.e., up to several octaves or up to and/or surpassing decade bandwidth), dielectric-free, metal-only, very-low-profile array of radiating apertures capable of supporting transmit and receive operation with arbitrary polarization states. The array of radiating apertures may be structurally-simple and suitable for additive manufacturing. The array of radiating apertures in accordance with the present invention may provide an antenna that is capable of scanning to angles approaching the grazing regime with acceptable active reflection coefficients. An array cell may be made from one dipole if just one polarization is required and/or from two such orthogonal dipoles to produce arbitrary polarization states. The dipoles may be self-supporting metal structures with integrated edge-coupling and feed networks to connect the dipoles to RF transmitter/receiver circuits below the ground plane. In addition, the array of electrically connected dipoles may be placed above and in parallel to the ground plane to permit unidirectional radiation in the upper semi-sphere.

Devices of the present invention may exclude the use of dielectric construction elements, because it can be difficult to find good low-loss dielectric for high frequencies. Dielectrics may introduce additional losses especially at higher frequencies, and can contribute to additional weight, size and cost. In addition, a top thick dielectric covering might cause array blindness by launching a surface wave instead of radiating the electromagnetic energy in designated scan directions. A metal-only radiator structure of the present invention may be made of two symmetrical loop-like, three-branch, metal parts. The first, generally vertical branch may start from a feed point near the ground plane enabling connection to the front-end circuits below the ground and may extend to certain height. Functionally, the first branch may serve for transmission of RF signals between the circuits below the ground plane and a second radiating branch. This second, generally horizontal section branch may form a radiating arm of the dipole. The second branch's functional role in the array may be to transmit or receive electromagnetic energy. At other end, the second, generally horizontal branch may extend close to the boundary of the array cell where a third, generally vertical branch starts. This third branch may then be shorted to ground. The function of this third, generally vertical branch may be twofold: (i) electrically, it may enable coupling between adjacent array cells through electro-magnetic coupling between the vertical sections of adjacent cells; (ii) mechanically, it may support the whole structure. Indeed, the structures of the present invention may be self-supporting and not require any additional support. In addition, the structures may be described by several parameters including cross-sectional dimensions, viz. to vertical ones and horizontal ones. Further, the second branch may start closer to the ground plane on the feed side than it ends on the side near the support. This may be done for impedance matching over a greater bandwidth than what would be typical for flat precisely horizontal branches. Moreover, the vertical branches do not have to couple using flat vertical surfaces. Coupling could be implemented using interwoven or interleaved edges, which would provide additional degrees of design freedom.

For some set of geometrical dimensions, a 100 Ohm differential impedance can be supported that enables next transformation to a pair of 50 Ohm single-ended impedance feeds below the ground plane. No additional impedance transformation is required. In the array structure of the present invention, common mode resonance may be shifted to the higher frequency end. Thus, the common mode resonance does not affect the major array passband. In the present structures, a bandwidth greater than an octave is supported. For example, for a 0.75 mm tall radiator (height of the third branch) the array can operate across 40-120 GHz and so on. In this configuration, the size of the unit cell is 1.4 mm on an edge. The cross section of the dipole structure could be between 50 microns and 250 microns or more. Moreover, the array may be configured to support arbitrary polarization states by combining two orthogonal linear polarizations. A dual-linear polarized array layout may be made in off-set or phase-center coincident mode.

BRIEF DESCRIPTION OF THE DRAWINGS

The foregoing summary and the following detailed description of exemplary embodiments of the present invention may be further understood when read in conjunction with the appended drawings, in which:

FIGS. 1*a*-1*c* schematically illustrate an exemplary configuration of a unit cell of a single-polarized antenna in accordance with the present invention, in which FIG. 1*a* illustrates a top-down view of the unit cell, FIG. 1*b* illustrates a isometric view, and FIG. 1*c* illustrates a cross-sectional view of FIG. 1*b* taken down a midline of differentially-fed shorted arms of the antenna;

FIGS. 3*a*-3*c* schematically illustrate another exemplary configuration of a unit cell of a single-polarized antenna similar to that of FIGS. 1*a*-1*c* but having a uniform cross-section in the antenna portions, in which FIG. 3*a* illustrates a top-down view of the unit cell, FIG. 3*b* illustrates a isometric view, and FIG. 3*c* illustrates a cross-sectional view of FIG. 3*b;*

FIGS. 7*a*-7*c* schematically illustrate a two-dimensional, 4-element by 4-element array of dual-polarized, differentially-fed, shorted dipoles in accordance with the present invention, in which FIG. 7*a* illustrates a top-down view of a unit cell of the array, FIG. 7*b* illustrates a isometric view of the unit cell, and FIG. 7*c* illustrates an isometric view of the array;

FIGS. 8*a*-8*c* schematically illustrate a further two-dimensional, 4-element by 4-element array of dual-polarized, differentially-fed, shorted dipoles in accordance with the present invention, in which FIG. 8*a* illustrates a top-down view of a unit cell of the array, FIG. 8*b* illustrates a isometric view of the unit cell, and FIG. 8*c* illustrates an isometric view of the array;

DETAILED DESCRIPTION OF THE INVENTION

Figure 1A:
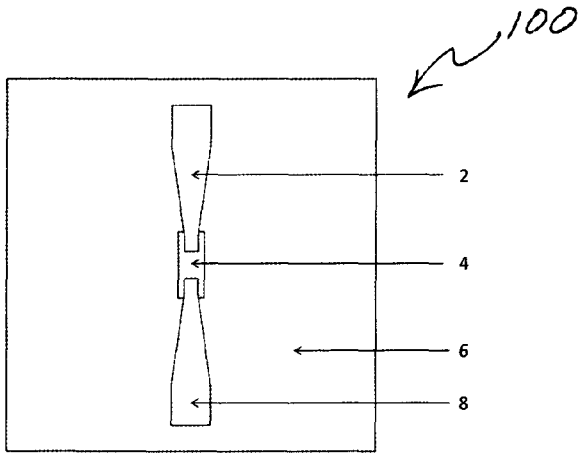
Figure 1B:
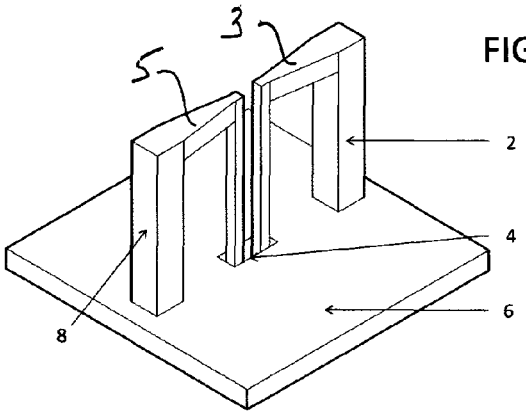
Figure 1C:
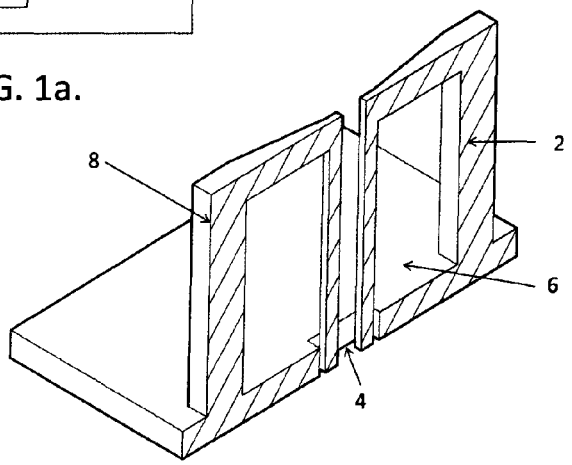
Figure 1D:
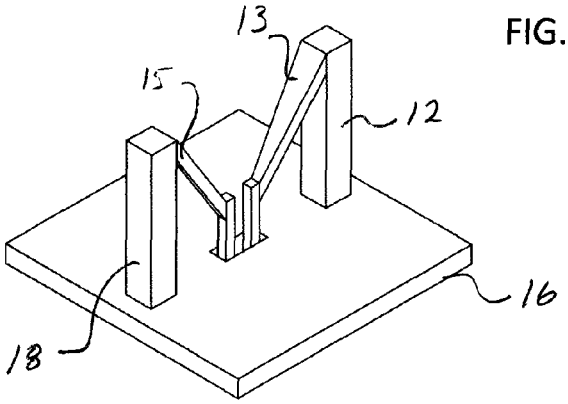
FIG. 1*d* schematically illustrates an alternative configuration of a unit cell of a single-polarized antenna in accordance with the present invention.
Figure 3A:
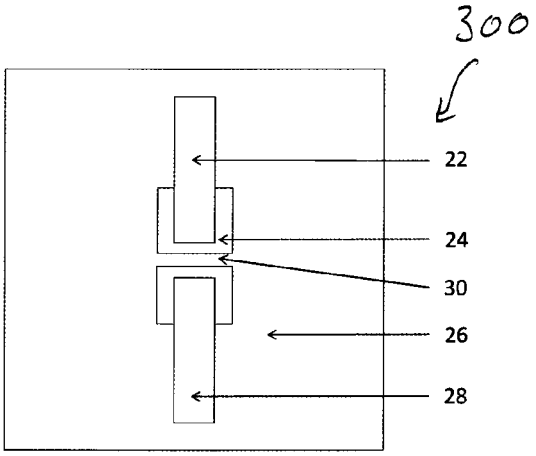
Figure 3B:
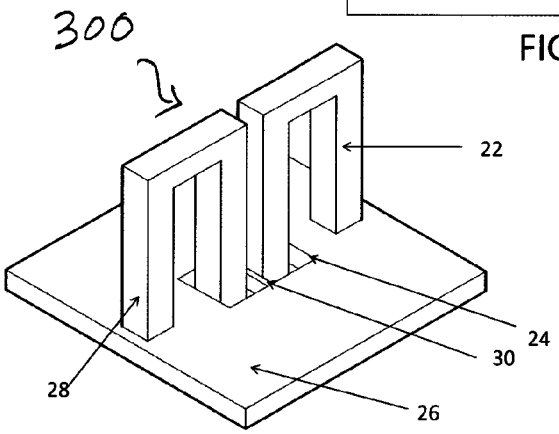

Referring now to the figures, wherein like elements are numbered alike throughout, FIGS. 1*a*-1*c* schematically illustrate an exemplary configuration of a unit cell 100 of a single-polarized antenna in accordance with the present invention. The antenna may include a differentially fed shorted arms 2, 8 of the antenna positioned above a ground surface (such as ground plane 6 or other surface shape, e.g., a conformal surface) and fed via a feed region 4, which may include one or more openings. (Though exemplary configurations of present invention may be illustrated as having a ground "plane", other surface shapes, such as conformal surfaces, may be provided for grounding.) The arms 2, 8 may cooperate to provide a dipole. The feed region 4 may be provided with no wall separating the feed points for the two differentially-fed shorted arms 2, 8. Alternatively, a wall 30 may be provided as illustrated in FIGS. 3*a*-3*b*. The arms 2, 8 may have a cross-sectional dimension that varies along the arms 2, 8 and may or may not be identical to one another. Alternatively, the arms 22, 28 may be 'U'-shaped of constant cross-sectional dimension depending on the requirements of the design or to optimize performance, FIGS. 3*a*-3*c*. Still further, opposing ends of the arms 2, 8 may be of the same height above the ground plane 6 with a horizontal leg 3, 5 therebetween, FIG. 1*b*. Instead, the opposing ends of the arms 12, 18 may be of different height above the ground plane 16 with a sloped leg 13, 15 therebetween, FIG. 1*d*. This may be done for impedance matching over a greater bandwidth than what would be typical for flat precisely horizontal legs.

Figure 2:
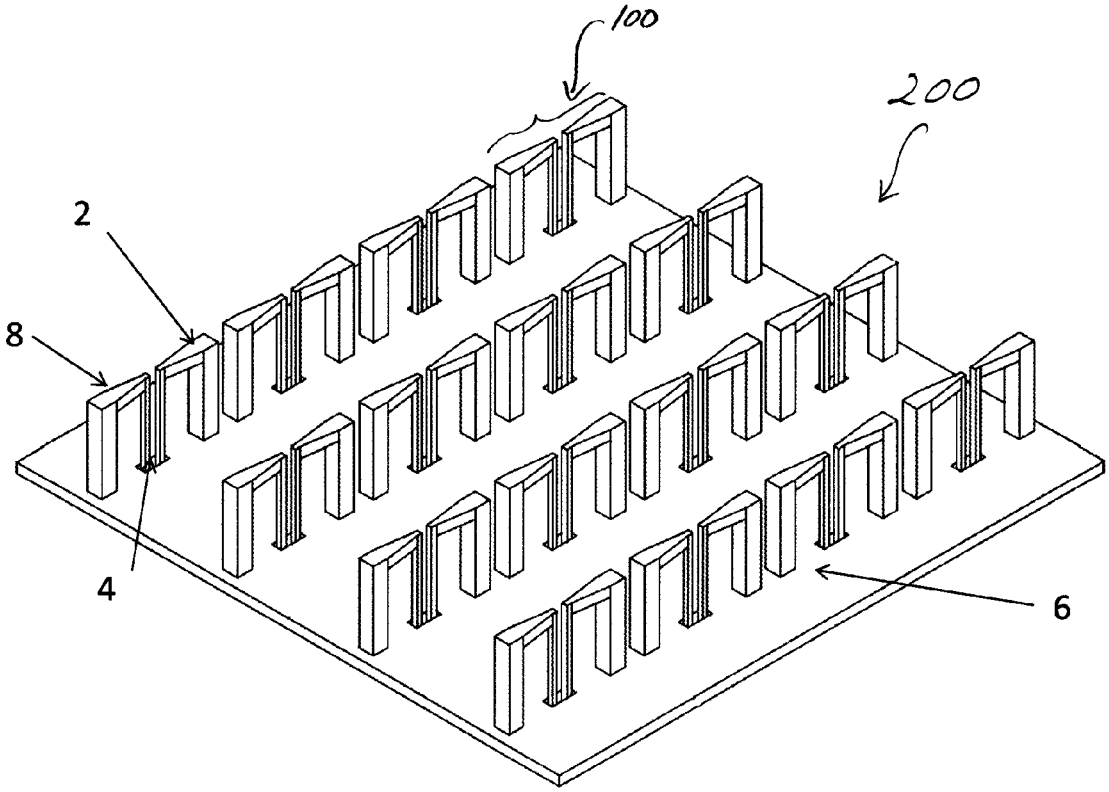
FIG. 2 schematically illustrates a four-element by four-element two-dimensional array of the single-polarized unit cell depicted in FIGS. 1*a*-1*c;*
Figure 3C:
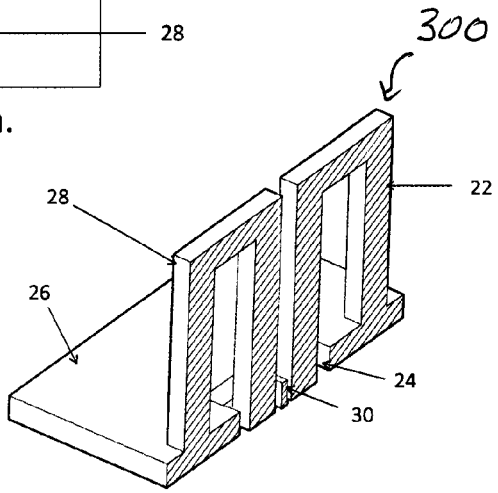
Figure 10A:
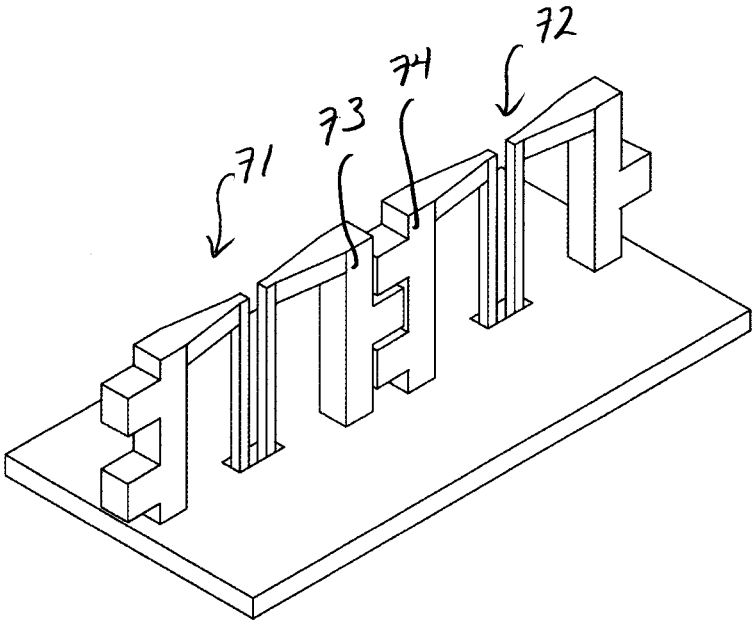
FIGS. 10*a*, 10*b* schematically illustrate coupling between the adjacent dipoles using interleaved or interwoven arms, respectively.

Similar to FIGS. 1*a*-1*c*, the structure of FIGS. 3*a*-3*c* may include a ground plane 26 and feed region 24. In addition, an array 200 of the antennas 100 of FIGS. 1*a*-1*c* (or antennas 300 of FIGS. 3*a*-3*c*) may be provided as illustrated in FIG. 2. In such as case the field generated by a dipole (i.e., pair of arms 2, 8) of the array 200 may be couple adjacent dipoles. For stronger coupling between the adjacent dipoles 71, 72, the legs 73, 74 could be interdigitated in either the vertical or horizontal direction (or both), FIG. 10*a*, which could be formed, for example, by the PolyStrata® process. Alternatively, the coupling between the adjacent dipoles 81, 82 may be implemented with interwoven legs 83, 84 that could be formed by 3D metal printing. Such coupling using interwoven or interleaved legs could provide additional degrees of design freedom.

Figure 4:
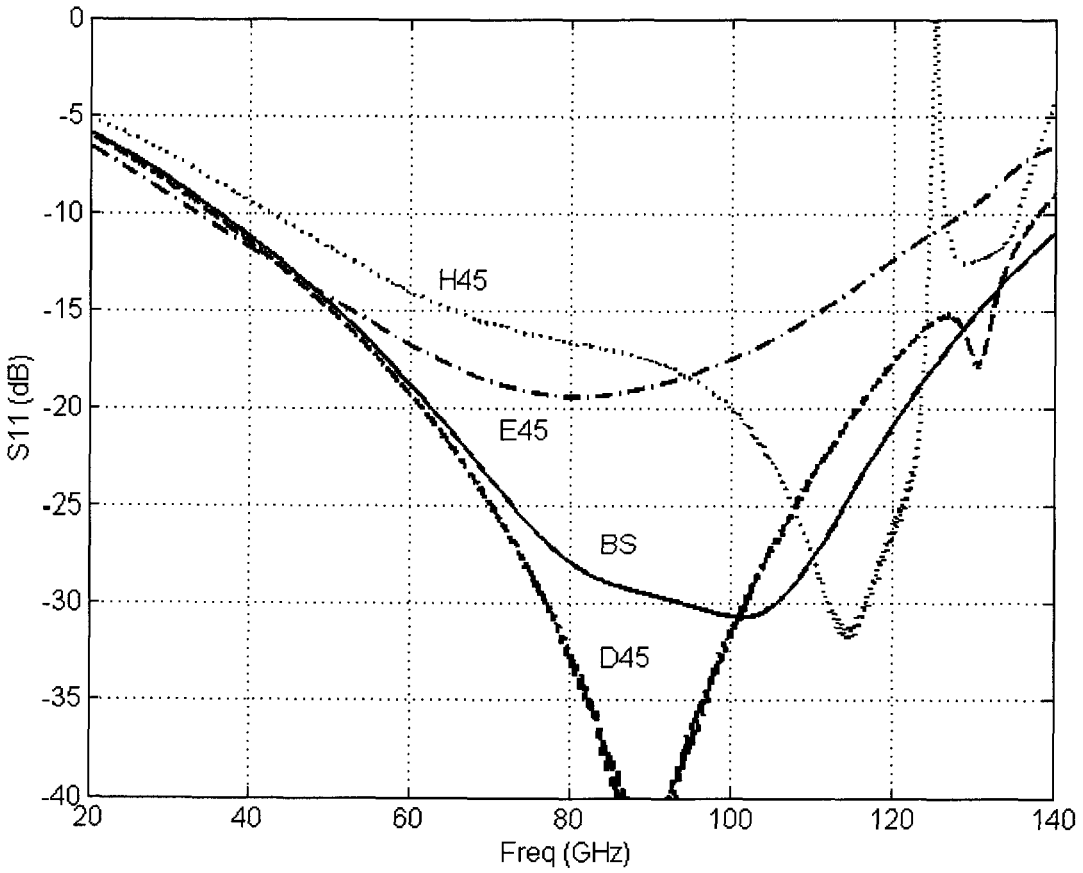
FIGS. 4-6 illustrate the expected performance of an antenna of the present invention.
Figure 5:
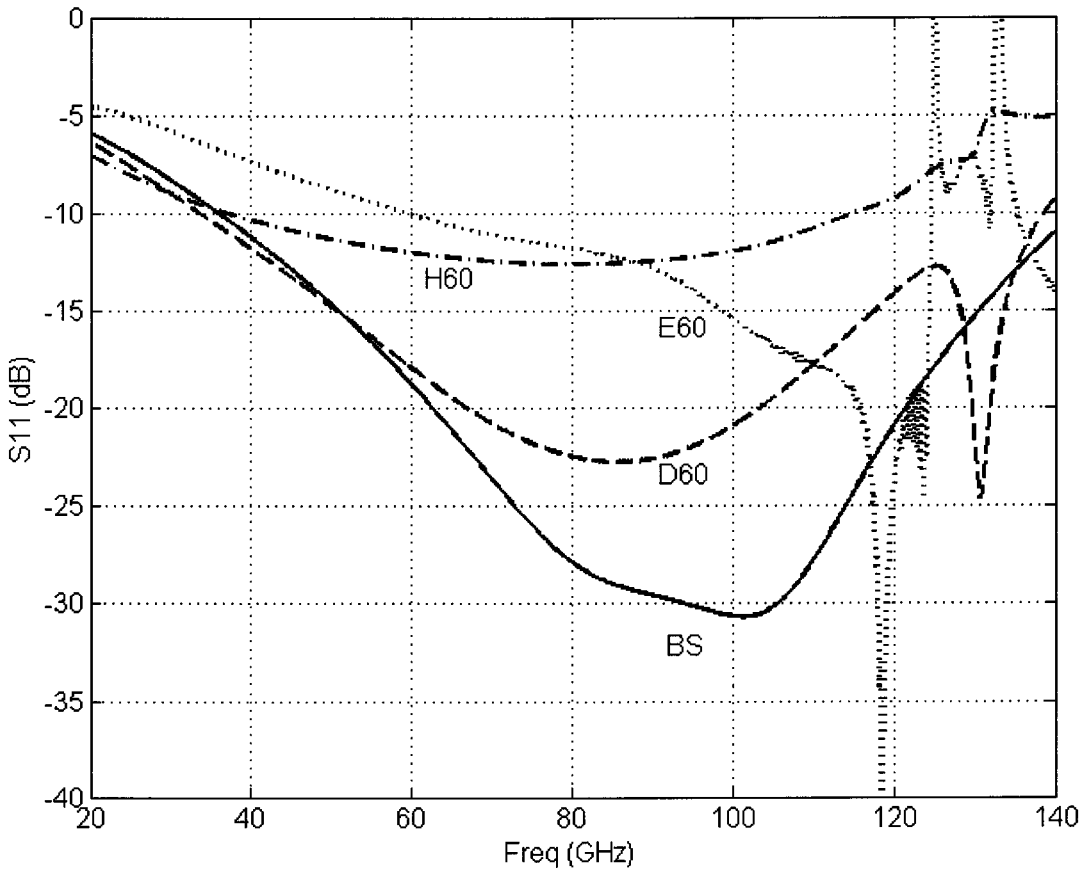
Figure 6:
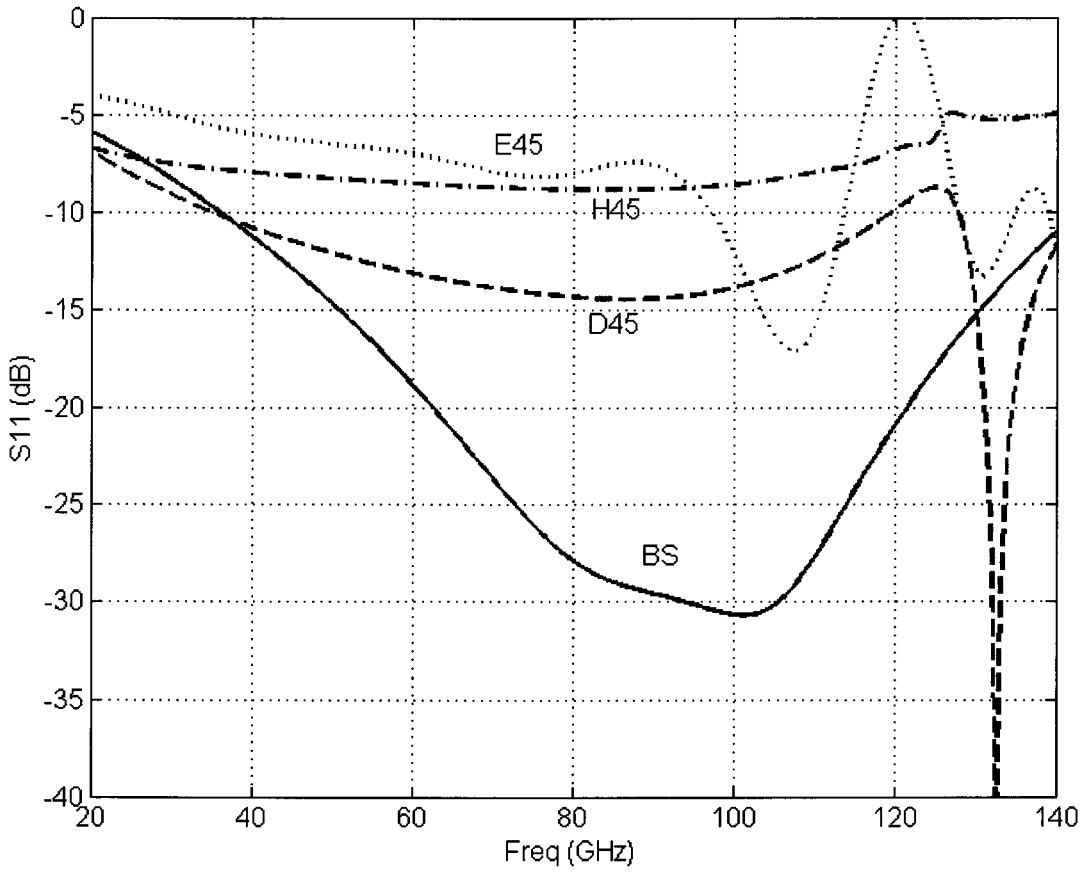

The expected performance of antenna designs of the present invention is illustrated in FIGS. 4-6 for a point design that should operate from roughly 40 GHz to 120 GHz. FIG. 4 illustrates the active reflection coefficient, comparing no scanning (BS) for an element in the array to when the element is driven to 45 degrees in the e plane (E45), or 45 degrees in the h plane of the antenna (H45), or 45 degrees in both planes (D45). FIG. 5 shows the active reflection coefficient, comparing no scanning (BS) for an element in the array to when the element is driven to 60 degrees in the e plane (E60), or 60 degrees in the h plane of the antenna (H60) or 60 degrees in both planes (D60). FIG. 6 shows the active reflection coefficient, comparing no scanning (BS) for an element in the array to when the element is driven to 75 degrees in the e plane (E75), or 75 degrees in the h plane of the antenna (H75) or 75 degrees in both planes (D75).

Figure 7A:
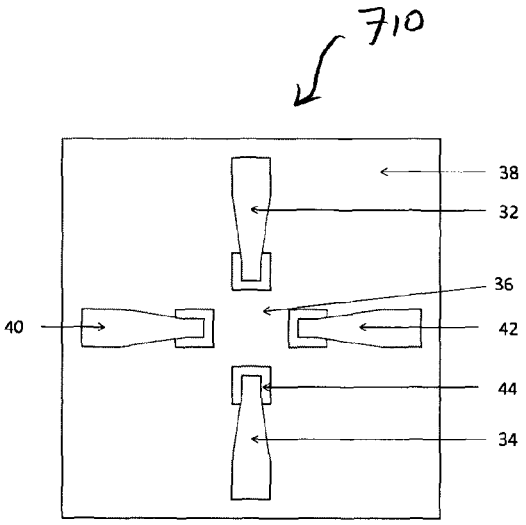
Figure 7B:
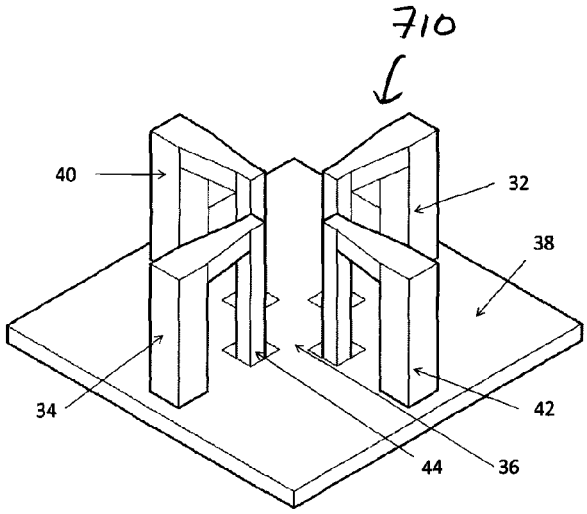
Figure 7C:
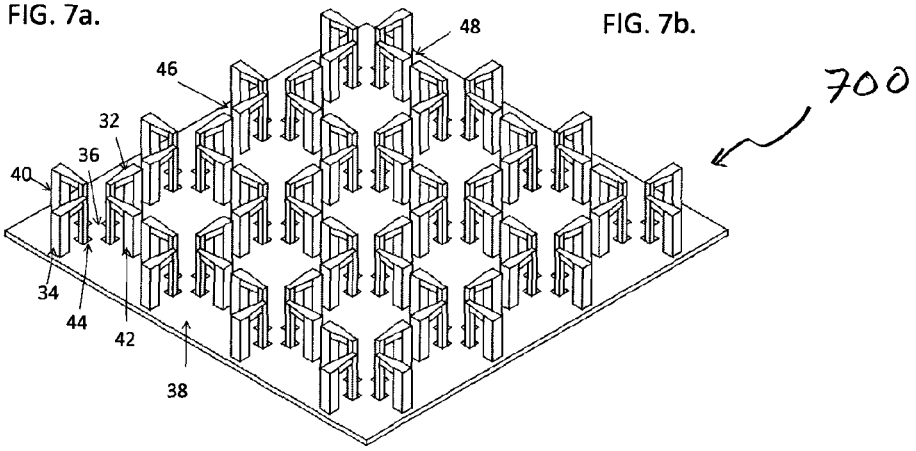

FIG. 7*c* shows a two-dimensional, 4-element by 4-element array 700 of dual-polarized differentially-fed shorted dipoles. The top view of the unit cell 710 that makes up the array 700 is shown in FIG. 7*a*. An isometric view of the unit cell 710 of the array 700 is shown in FIG. 7*b*. An isometric view of a representative 4×4 array 700 is shown in FIG. 7*c*. Arms 32 and 34 make up two halves of a first differentially-fed dipole element that is fed in polarization 1. Polarization 2 is orthogonal to polarization 1 and is fed by arms 40 and 42, which make up the two halves of a second differentially-fed dipole element. The shorted dipole elements that are oriented in the same direction as 32 and 34 throughout the array 700 also feed polarization 1. This polarization means that the electric field vectors for electromagnetic waves are oriented in the same direction as the long dimension of the physical components of arms 32 and 34 that are oriented parallel to ground plane 38. A coupling gap 46 may exist in the antenna array 700 between adjacent dipoles for Polarization 1, and a coupling gap 48 may exist in the array 700 between adjacent dipoles for Polarization 2. The phase center for the orthogonal polarizations associated with each unit cell is in the same location, because arms 32, 34 and arms 40, 42 are centered about the feed region, 36. Aperture 44 is the feed aperture for arm 34, but the whole feed region 36 could be a single aperture that allows all of the feeds from arms 32, 34, 40, 42 to pass through if the dimensions are too small to allow walls to exist between individual the dipole feeds.

Figure 8A:
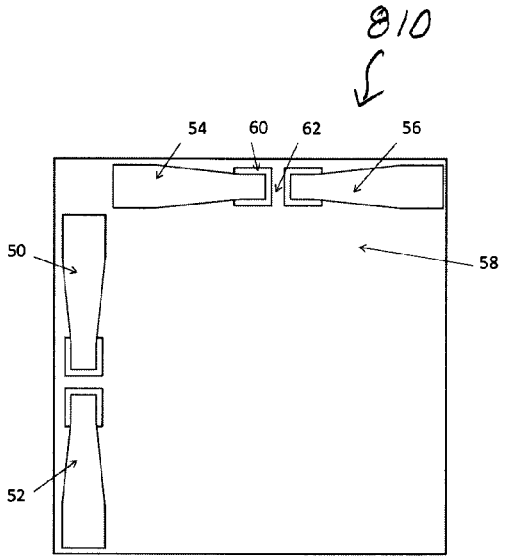
Figure 8B:
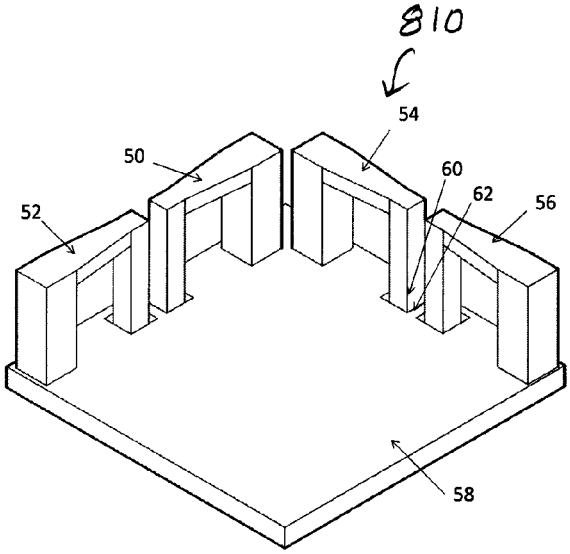
Figure 8C:
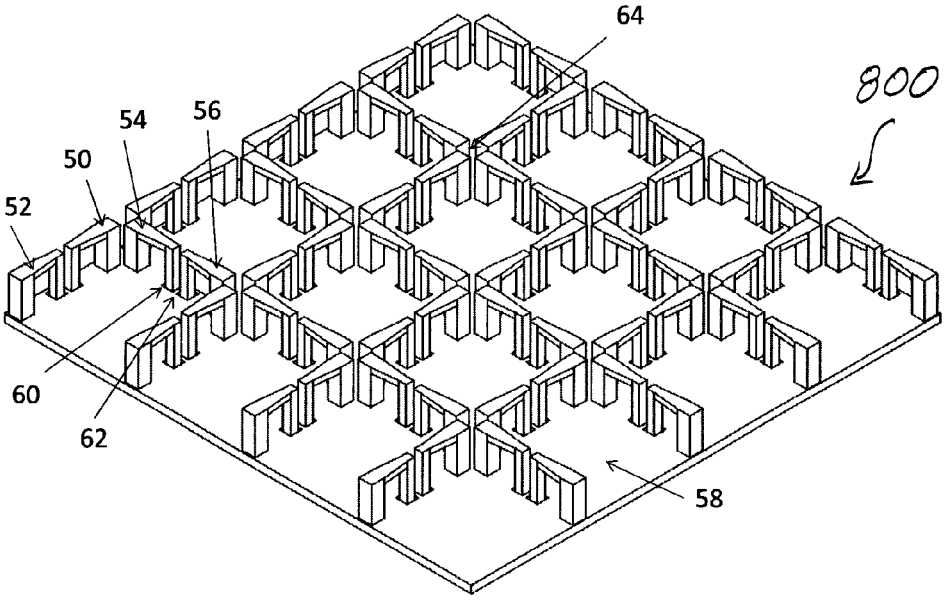
Figure 10B:
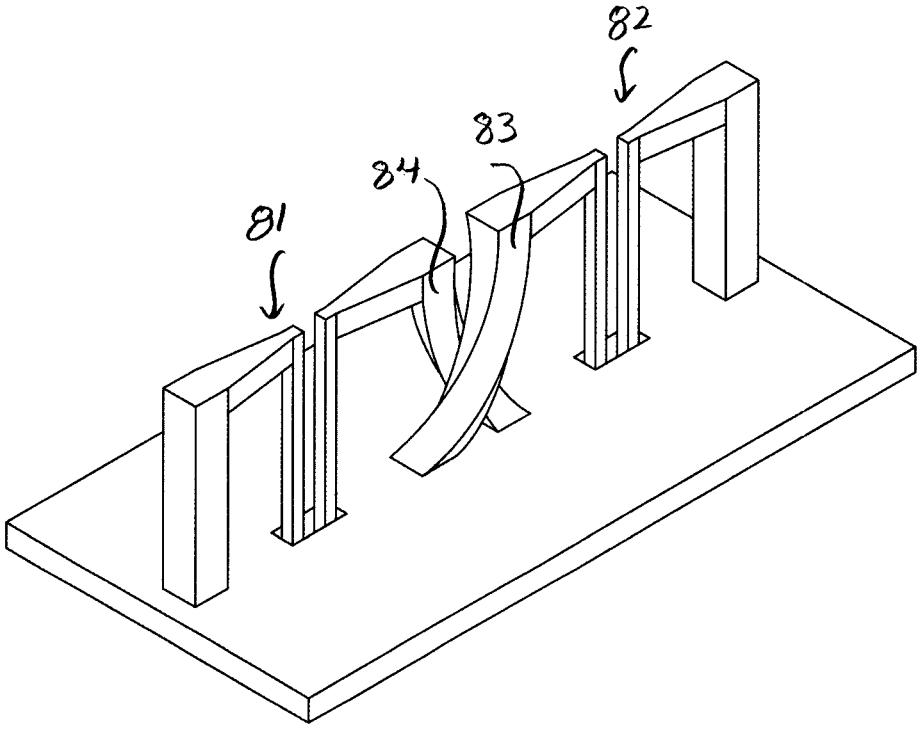

FIG. 8*c* shows a two-dimensional, 4-element by 4-element array 800 of dual-polarized differentially-fed shorted dipoles. The top view of the unit cell 810 that makes up the array 800 is shown in FIG. 8*a*. An isometric view of the unit cell 810 of the array 800 is shown in FIG. 8*b*. An isometric view of a representative 4×4 array 800 is shown in FIG. 8*c*. Arms 50, 52 make up two halves of a differentially-fed dipole element that is fed in polarization 1. Polarization 2 is orthogonal to polarization 1 and is fed by arms 54, 56, which make up the two halves of a second differentially-fed dipole element. The shorted dipole elements that are oriented in the same direction as arms 50, 52 throughout the array 800 also feed polarization 1. This polarization means that the electric field vectors for electromagnetic waves are oriented in the same direction as the physical components of arms 50, 52 that are oriented parallel to ground plane 58. A coupling gap 64 may exist between the adjacent dipoles for both polarizations. These coupling gaps 64 could be simple, as shown in the drawing, or they could be interdigitated in such a way as to selectively couple between adjacent dipoles for a given polarization, FIGS. 10*a*, 10*b*. The phase center for each polarization is centered between the two dipole arms associated with said polarization and the two phase centers for each polarization are offset with respect to the other. Aperture 60 is a feed region for the differentially shorted dipole arms 54, 56. A separation wall 62 may or may not exist between the arms 54, 56. One may choose to use offset orthogonal elements, as shown in FIGS. 8*a*-8*c*, to make it easier to place the beam-forming electronics behind the array.

Figure 9:
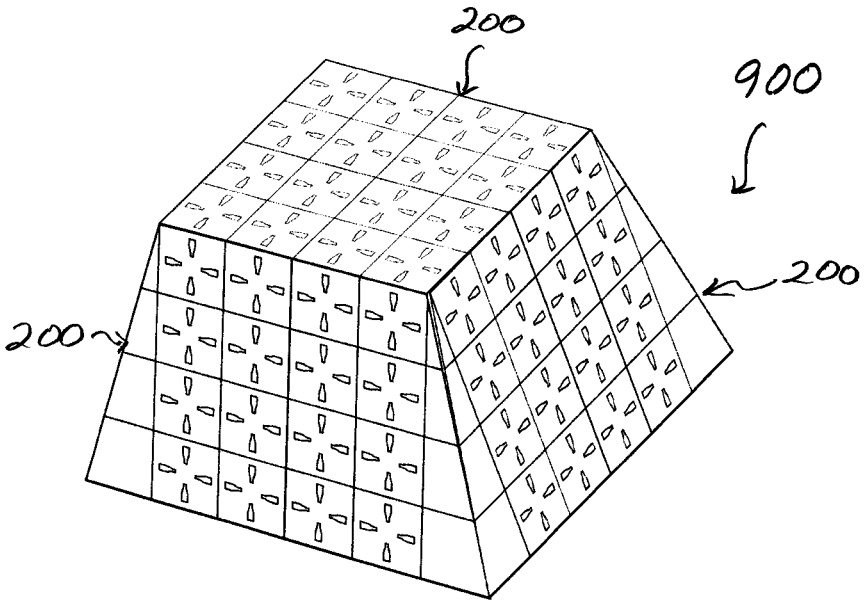
FIG. 9 schematically illustrates a three-dimensional array comprising multiple two-dimensional arrays of the present invention, such as the arrays of FIGS. 2, 7, 8.

These and other advantages of the present invention will be apparent to those skilled in the art from the foregoing specification. For instance, a plurality of two-dimensional arrays, such as the arrays 200, 700, 800, may be combined to provide a three-dimensional array 900, FIG. 9. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims.

What is claimed is:

1. A dipole-coupled broadband radiator structure, comprising:

a ground surface having first and second openings disposed therethrough; and adjacent first and second dipole antennas each comprising two loops with each loop disposed in a respective plane perpendicular to the ground plane, a selected one of the loops of each of the antennas having a first end shorted to the ground surface and a second end disposed in a respective one of the first and second openings, with the respective planes of a selected loop of each of the first and second antennas disposed perpendicular to one another.

2. The dipole-coupled broadband radiator structure according to claim 1, wherein the loops comprise self-supporting metal structures.

3. The dipole-coupled broadband radiator structure according to claim 1, comprising RF transmitter/receiver circuits below the ground surface in electrical communication with the second end of each loop of the first and second antennas.

4. A two-dimensional array of radiator structures according to any of the preceding claims, wherein a selected first end of the first dipole antenna is capacitively coupled to a selected first end of the adjacent second dipole antenna.

5. A plurality of two-dimensional arrays according to claim 4, arranged to provide a three-dimensional array.

6. The two-dimensional array according to claim 4, wherein the length of a unit cell of the two dimensional array taken along the ground surface is approximately half of a wavelength at the upper end of the frequency range over which the array operates.

7. A two-dimensional array of radiator structures according to claim 1, wherein each antenna has a leg, and wherein respective adjacent legs of the adjacent first and second dipole antennas are interdigitated.

8. A two-dimensional array of radiator structures according to claim 1, wherein each antenna has a leg, and wherein respective adjacent legs of the adjacent first and second dipole antennas are interwoven.

9. The dipole-coupled broadband radiator structure according to claim 1, wherein each loop of the second dipole antenna has a first end shorted to the ground surface and a second end disposed in the second opening.

* * * * *